US008950296B2

(12) United States Patent
Liao

(10) Patent No.: US 8,950,296 B2
(45) Date of Patent: Feb. 10, 2015

(54) RATCHETING WRENCH

(75) Inventor: Jyun-Wun Liao, Taichung (TW)

(73) Assignee: Cheng-Wei Su, Taichung (TW)

( * ) Notice: Subject to any disclaimer, the term of this patent is extended or adjusted under 35 U.S.C. 154(b) by 488 days.

(21) Appl. No.: 13/300,852

(22) Filed: Nov. 21, 2011

(65) Prior Publication Data

US 2012/0137836 A1 Jun. 7, 2012

(30) Foreign Application Priority Data

Dec. 6, 2010 (TW) ..... 99142304 A

(51) Int. Cl.
*B25B 13/06* (2006.01)
*B25B 13/04* (2006.01)
*B25B 13/46* (2006.01)

(52) U.S. Cl.
CPC ..... *B25B 13/04* (2013.01); *B25B 13/065* (2013.01); *B25B 13/46* (2013.01)
USPC ..... 81/121.1

(58) Field of Classification Search
CPC ..... B25B 13/06; B25B 13/065; B25B 13/56; B25B 13/08; B25B 13/48; B25B 13/02; F46B 23/0061
USPC ..... 81/121.1, 124.2, 124.3, 125.1, 125, 81/126, 119
See application file for complete search history.

(56) References Cited

U.S. PATENT DOCUMENTS 2,202,240 A * 5/1940 Trotter ..... 81/124.6
3,931,749 A 1/1976 Evans
6,158,309 A * 12/2000 Baker ..... 81/119
6,626,067 B1 * 9/2003 Iwinski et al. ..... 81/121.1
7,181,998 B2 2/2007 Matsumoto et al.
2004/0025642 A1 2/2004 Hsien
2005/0279192 A1 * 12/2005 Richter ..... 81/58.3

FOREIGN PATENT DOCUMENTS

| | | |
|---|---|---|
| TW | 333491 | 6/1998 |
| TW | 354513 | 3/1999 |
| TW | 373543 | 11/1999 |
| TW | 386050 | 4/2000 |
| TW | 549186 | 8/2003 |
| TW | 567948 | 12/2003 |
| TW | M241176 | 8/2004 |
| TW | I285149 | 5/2005 |
| TW | I287492 | 7/2006 |
| TW | I305164 | 6/2007 |
| TW | M331416 | 5/2008 |
| TW | M358038 | 6/2009 |
| TW | M393390 | 12/2010 |
| TW | D150150 | 11/2012 |

* cited by examiner

*Primary Examiner* — Robert Scruggs
(74) *Attorney, Agent, or Firm* — Alan D. Kamrath; Kamrath IP Lawfirm, P.A.

(57) ABSTRACT

A ratcheting wrench includes a driving head having a receiving hole defined through the driving head. The driving head includes an inner flange and multiple teeth. The inner flange inwardly extends from an inner surface of the receiving hole. The multiple teeth extend from the inner surface of the receiving hole. Each tooth has a bottom connected to the inner flange and includes an upper edge, a first side, a second side and a beveled ridge. The beveled ridge extends from a juncture between the first side and the upper edge to the inner flange, gradually and inwardly protrudes from an inner surface of the tooth, and includes an engaging bevel and a guiding bevel. The wrench body continuously rotates a fastener without detaching from the fastener.

10 Claims, 14 Drawing Sheets

RATCHETING WRENCH

BACKGROUND OF THE INVENTION

1. Field of the Invention

The present invention relates to a wrench and more particularly, to a ratcheting wrench.

2. Description of Related Art

With Reference to FIG. 14, a conventional wrench includes a wrench body 10. The wrench body 10 has a head 11 disposed on the wrench body 10. The head 11 has an opening 12 defined in the head 11. The head 11 has multiple protrusions 13 and multiple indentations 14 disposed in an inner surface in the opening 12 in the head 11. The protrusions 13 and the indentations 14, are alternately arranged to form a toothed structure. The opening 12 in the wrench body 10 is provided for receiving a hexagon fastener. The corners of the fastener are received in the indentations 14 and the edges of the fastener abut the protrusions 13, such that the fastener is rotatably driven by the wrench body 10.

When the wrench body 10 is operated, a rotatable moving range of the wrench body 10 is restricted by a moving range of the human wrist. When the wrench body 10 is rotated about forty-five degrees relative to a pivot of the fastener, the fastener needs to be detached from the opening 12, and the wrench body 10 is rotated about forty-five degrees along a reverse direction. The fastener is received in the opening 12 and is driven by the wrench body 10 again. However, the fastener is repeatedly detached from and reloaded in the opening 12 in the wrench body 10, such that operating the conventional wrench is slow and inconvenient.

To overcome the shortcomings, the present invention provides a ratcheting wrench to mitigate or obviate the aforementioned problems.

SUMMARY OF THE INVENTION

The main objective of the invention is to provide a ratcheting wrench that includes a driving head having a receiving hole defined through the driving head. The driving head includes an inner flange and multiple teeth. The inner flange inwardly extends from an inner surface of the receiving hole in the driving head. The multiple teeth extend from the inner surface of the receiving hole in the driving head. Each tooth has a bottom connected to the inner flange and includes an upper edge, a first side, a second side and a beveled ridge. The upper edge is disposed on a top of the tooth. The first side is located at one side of the tooth. The second side is located at another side of the tooth and is opposite to the first side. The beveled ridge extends from a juncture between the first side and the upper edge to the inner flange, gradually and inwardly protrudes from an inner surface of the tooth, and includes an engaging bevel and a guiding bevel. The engaging bevel is inclined toward a juncture between the first side and the inner flange and is connected to the first side and the inner flange. The guiding bevel interfaces with the engaging bevel and is inclined toward the juncture between the upper edge and the second side.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
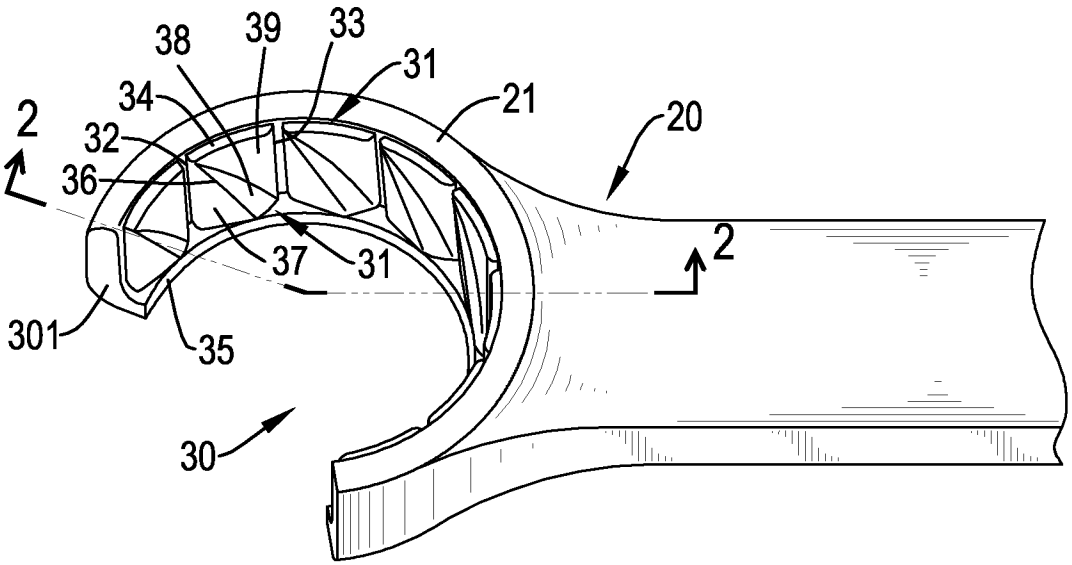
FIG. 1 is a perspective view of a ratcheting wrench of a first embodiment in accordance with the present invention.
Figure 2:
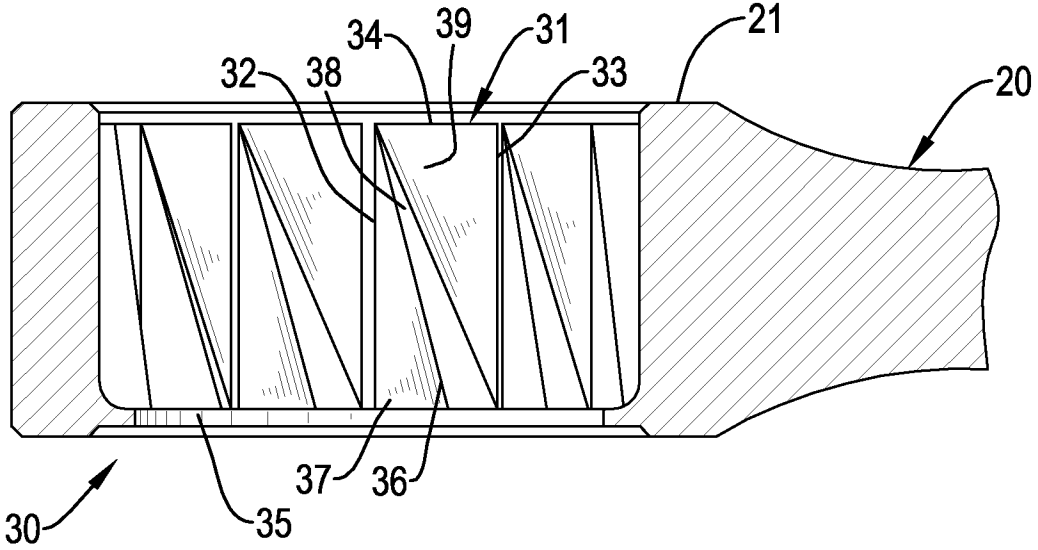
FIG. 2 is a cross sectional side view of the ratcheting wrench in FIG. 1.

With reference to FIGS. 1 and 2, a ratcheting wrench of a first embodiment in accordance with the present invention comprises a wrench body 20 and a driving head 21 disposed on the wrench body 20. The driving head 21 is provided for driving a fastener, such as a bolt or a nut. The driving head 21 has a receiving hole 30, an inner flange 35 and multiple teeth 31. The receiving hole 30 is defined through the driving head 21 for receiving the fastener. Preferably, the driving head 21 has an opening 301 laterally defined through the driving head 21 and communicating with the receiving hole 30, such that the driving head 21 is C-shaped.

The inner flange 35 inwardly extends from an inner surface of the receiving hole 30 in the driving head 21. The multiple teeth 31 extend from the inner surface of the receiving hole 30 in the driving head 21. Preferably, eight teeth 31 are equidistantly arranged on the inner surface of the receiving hole 30 in the driving head 21. Each tooth 31 has a bottom connected to the inner flange 35 and includes an upper edge 34, a first side 32, a second side 33 and a beveled ridge 36. The upper edge 34 is disposed on a top of the tooth 31. The first side 32 and the second side 33 are respectively located at two opposite sides of the tooth 31 and are spaced from each other. The first side 32 and the second side 33 are upwardly connected with the upper edge 34 and are downwardly connected with the inner flange 35. The beveled ridge 36 may be a tetrahedron-like element, extends from a juncture between the first side 32 and the upper edge 34 to an inner surface of the inner flange 35 and gradually and inwardly protrudes from an inner surface of the tooth 31. The beveled ridge 36 includes an engaging bevel 37 and a guiding bevel 38. The engaging bevel 37 is inclined toward a juncture between the first side 32 and the inner flange 35 and is connected to the first side 32 and the inner flange 35. The guiding bevel 38 interfaces with the engaging bevel 37 and is inclined toward the juncture between the upper edge 34 and the second side 33. A connecting surface 39 is located among the beveled ridge 36, the second side 33 and the upper edge 34. The connecting surface 39 is connected with the second side 33, the upper edge 34 and the guiding bevel 38 of the beveled ridge 36.

Figure 3:
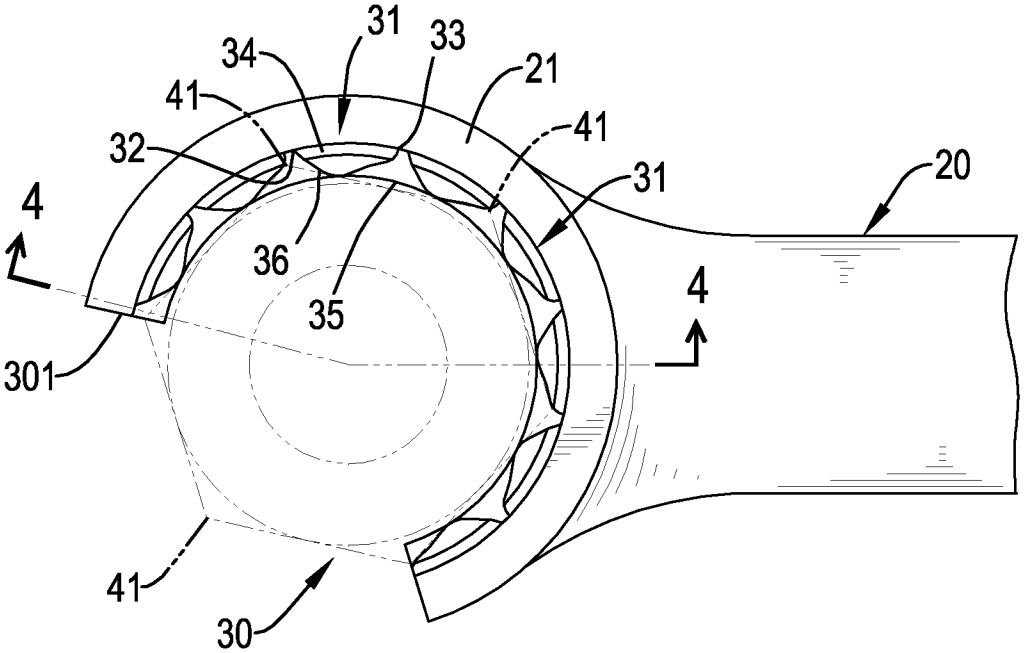
FIG. 3 is a top view of the ratcheting wrench in the present invention engaging a fastener.

With reference to FIG. 3, a hexagonal fastener 40 is received in the receiving hole 30. The fastener 40 has four edges located in the receiving hole 30, and each of the four edges abuts the adjacent two of the eight teeth 31. The fastener 40 has three corners 41, and each corner 41 is formed on adjacent two of the four edges of the fastener 40. Each of the three corners 41 of the fastener 40 is correspondingly located at the adjacent two of the eight teeth 31 and is located between and abuts the first side 32 of one of the adjacent two teeth 31 and the second side 33 of the other one of the adjacent two teeth 31.

Figure 4:
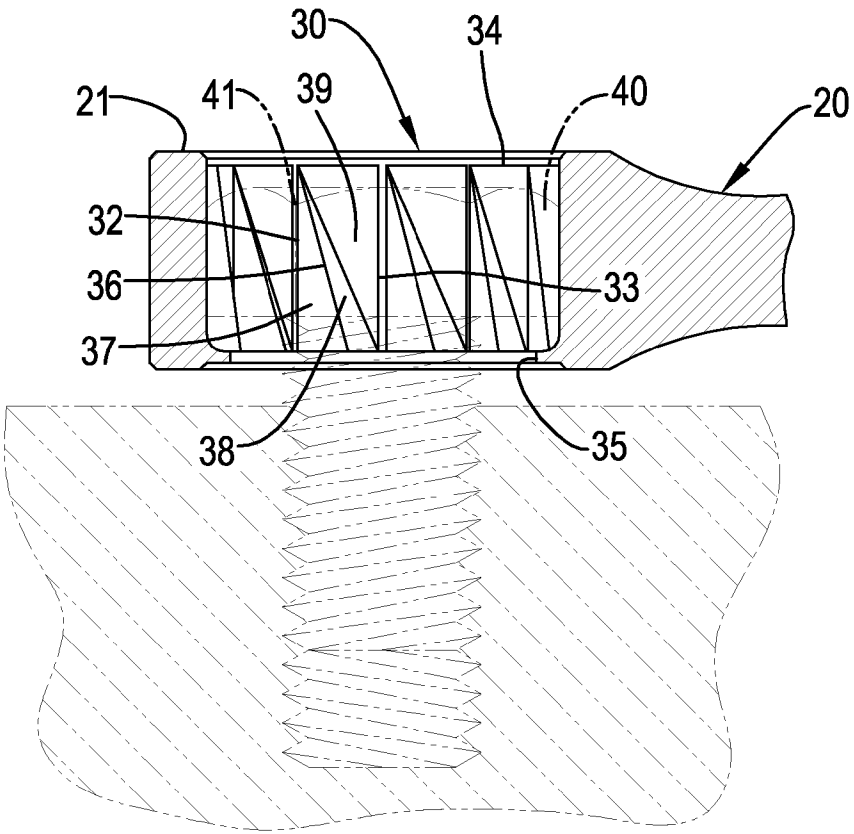
FIG. 4 is a side view in partial section of the ratcheting wrench in FIG. 3.

With reference to FIG. 4, a top surface of the fastener 40 abuts the inner flange 35. The wrench body 20 is pivotally operated as a pivot of the fastener 40.

Figure 5:
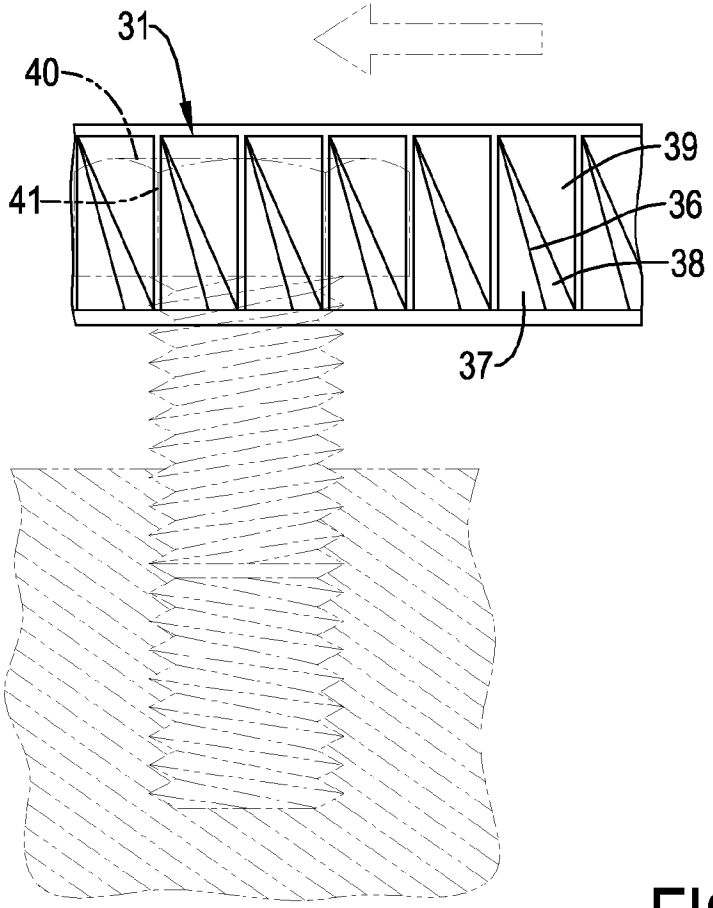
FIG. 5 is a side view in partial section of the ratcheting wrench rotating the fastener.
Figure 6:
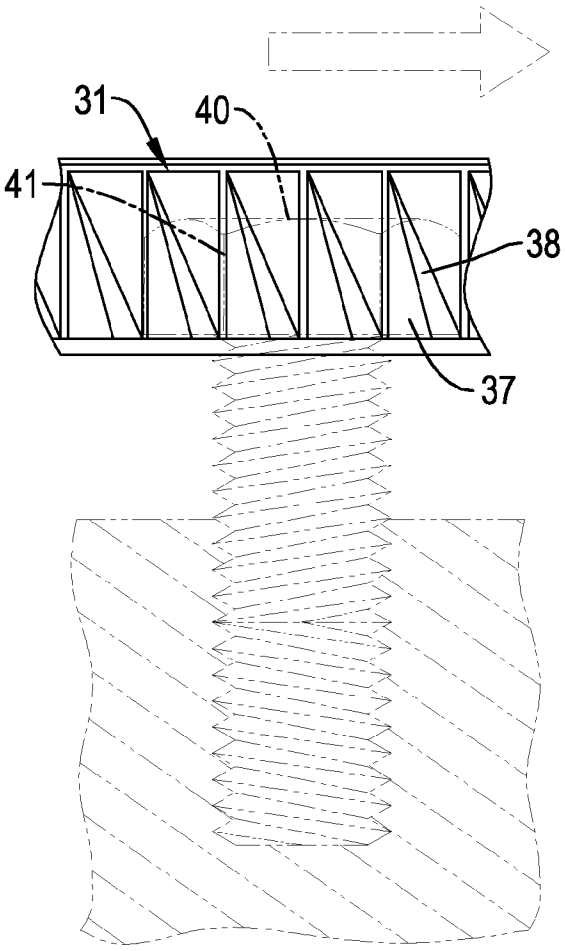
FIGS. 6 to 9 are operational side views of the ratcheting wrench in FIG. 4.
Figure 7:
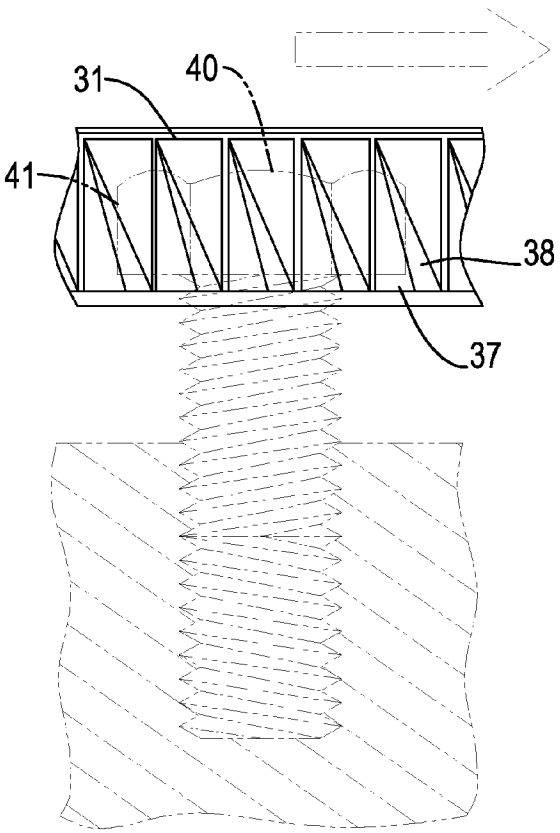
Figure 8:
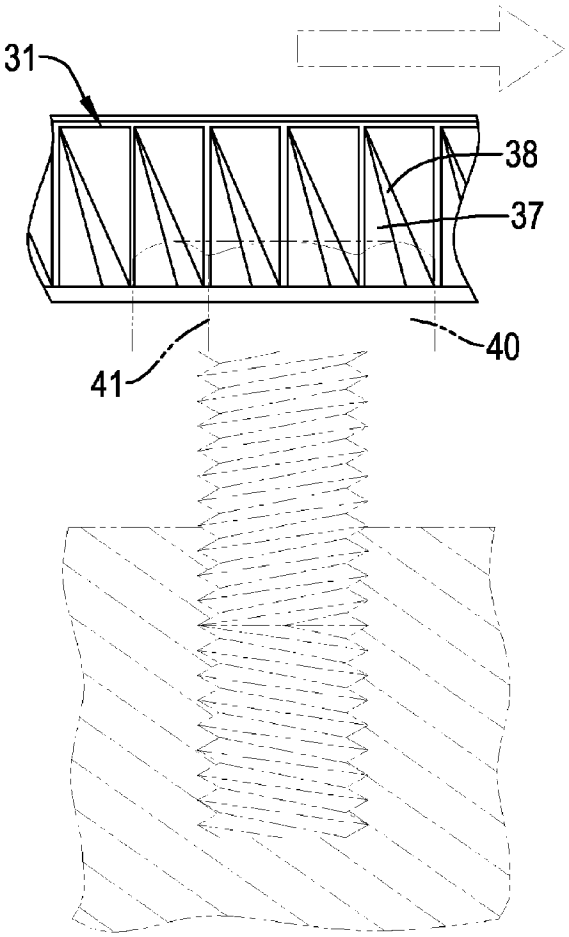
Figure 9:
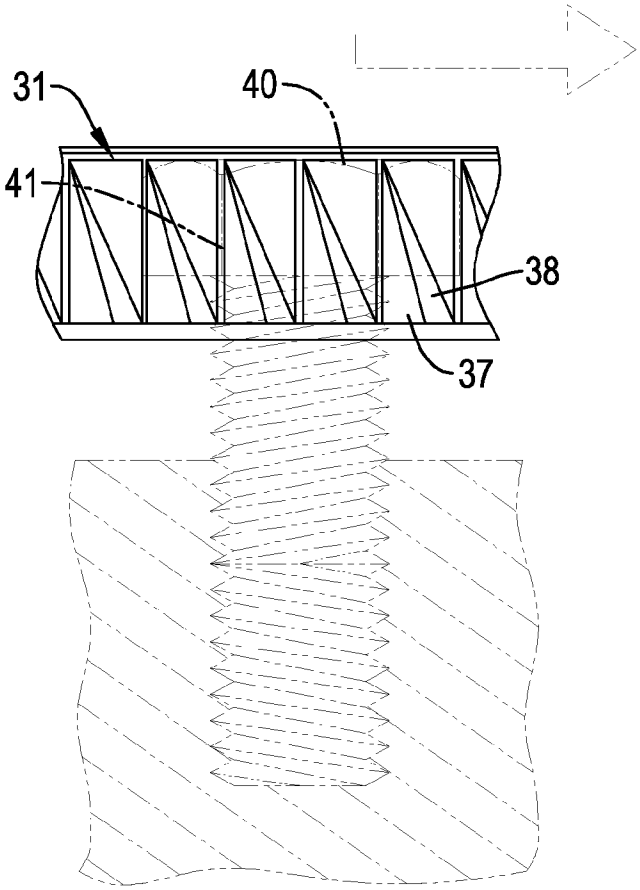

With reference to FIG. 5, the engaging bevels 37 of corresponding teeth 31 are correspondingly restricted and abut the four edges of the fastener 40, such that the fastener 40 is rotated.

With reference to FIGS. 6 to 9, after the fastener 40 is rotated in an angular distance, the wrench body 20 is reversely operated. During the movement of the wrench body 20, the three corners 41 of the fastener 40 correspondingly slide along the guiding bevel 38 of the corresponding teeth 31, such that the driving head 21 of the wrench body 20 is lifted relative to the fastener 40. Each of the three corners 41 slides to a juncture between the guiding bevel 38 and the upper edge 34 of the corresponding tooth 31 and then slides to the second side 33 of an adjacent tooth 31. When the wrench body 20 is reversely operated, the three corners 41 of the fastener 40 are not reversely rotated and slidably jump to the second sides 33 of the adjacent teeth 31.

The present invention utilizes the engaging bevel 37 of the beveled ridge 36 of each tooth 31 to abut against the corresponding side of the fastener 40 for rotating the fastener 40. During the reverse operation of the wrench body 20, the guiding bevel 38 of the beveled ridge 36 of each tooth 31 is provided for guiding the corresponding corner 41 of the fastener 40 sliding along the guiding bevel 38 and jumping to the adjacent teeth 31, such that the wrench body 20 is reversely pivotable and will not be detached from the fastener 40 to provide a ratcheting effect.

The engaging bevel 37 of the beveled ridge 36 of each tooth 31 abuts against the corresponding side of the fastener 40 for rotating the fastener 40. During the reverse operation of the wrench body 20, the guiding bevel 38 of the beveled ridge 36 of each tooth 31 is provided for guiding the corresponding corner 41 of the fastener 40 sliding along the guiding bevel 38 and jumping to the adjacent teeth 31, such that the wrench body 20 is reversely pivotable and will not be detached from the fastener 40 to provide a ratcheting effect.

Figure 10:
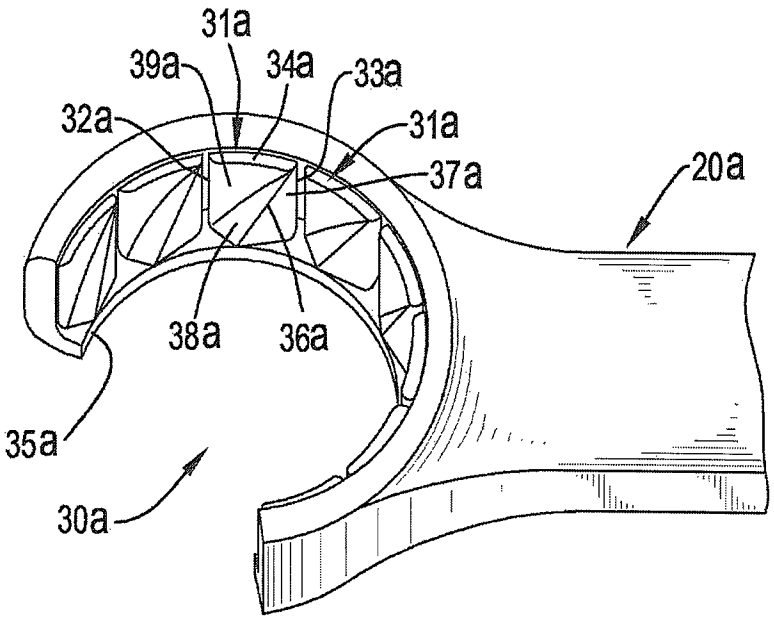
FIG. 10 is a perspective view of a second embodiment of the ratcheting wrench in accordance with the present invention.

With reference to FIG. 10, in a second embodiment of the ratcheting wrench in accordance with the present invention, the elements and effects of the second embodiment are the same with the first embodiment except that the beveled ridge 36*a* of each tooth 31*a* of the wrench body 20*a* is inclined toward another direction. The beveled ridge 36*a* extends from a juncture between the second side 33*a* and the upper edge 34*a* to the inner surface of the inner flange 35*a* and gradually and inwardly protrudes from the inner surface of the tooth 31*a*. The engaging bevel 37*a* is inclined toward a juncture between the second side 33*a* and the inner flange 35*a* and is connected to the second side 33*a* and the inner flange 35*a*. The guiding bevel 38*a* is inclined toward a juncture between the upper edge 34*a* and the first side 32*a*. The connecting surface 39*a* is located among the guiding bevel 38*a* of the beveled ridge 36*a*, the first side 32*a* and the upper edge 34*a*.

Figure 11:
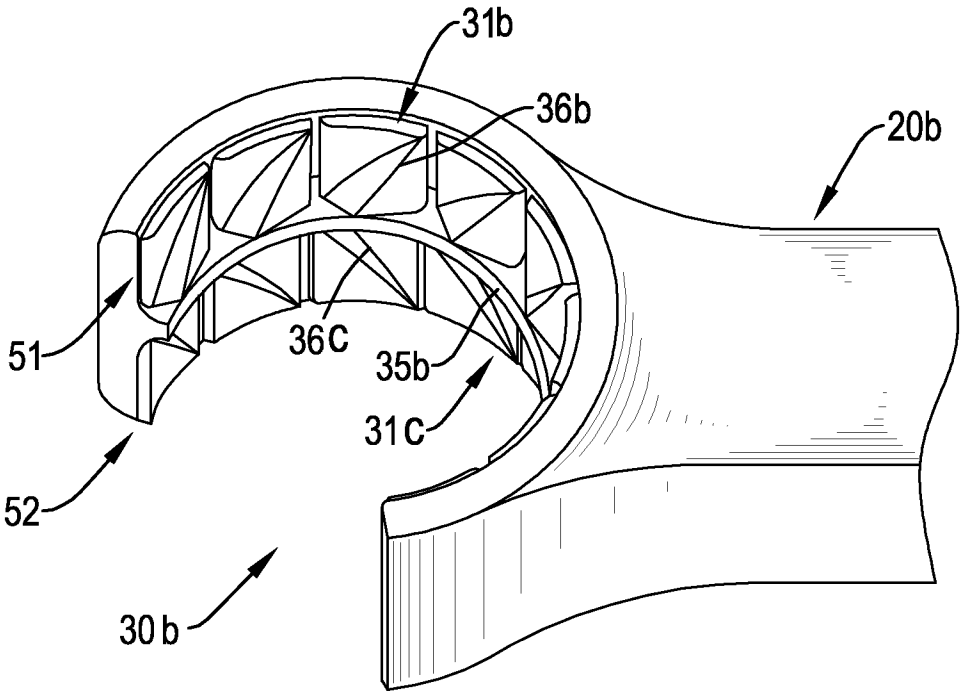
FIG. 11 is a perspective view of a third embodiment of the ratcheting wrench in accordance with the present invention.

With reference to FIG. 11, in a third embodiment of the ratcheting wrench in accordance with the present invention, the elements and effects of the third embodiment are the same with the first embodiment, except that a top and a bottom of the inner flange 35*b* are divided into a first section 51 and a second section 52. Each of the first section 51 and the second section 52 has multiple teeth 31*b*, 31*c* protruding from the inner surface of the receiving hole 30*b* of the wrench body 20*b*. Preferably, the first section 51 has eight teeth 31*b*, and the second section 52 has eight teeth 31*c* equidistantly arranged on the inner surface of the receiving hole 30*b*. An inclined direction of the beveled ridge 36*b* of each tooth 31*b* of the first section 51 differs from an inclined direction of the beveled ridge 36*c* of each tooth 31*c* of the second section 52. The first inclined direction of each beveled ridge 36*b* of the first section 51 and the second inclined direction of each beveled ridge 36*c* of the second section 52 are mirror-imaged and are crossed to form an obtuse angle, such that an operational direction of the first section 51 is opposite to that of the second section 52 for providing a tightening effect and a loosening effect.

Figure 12:
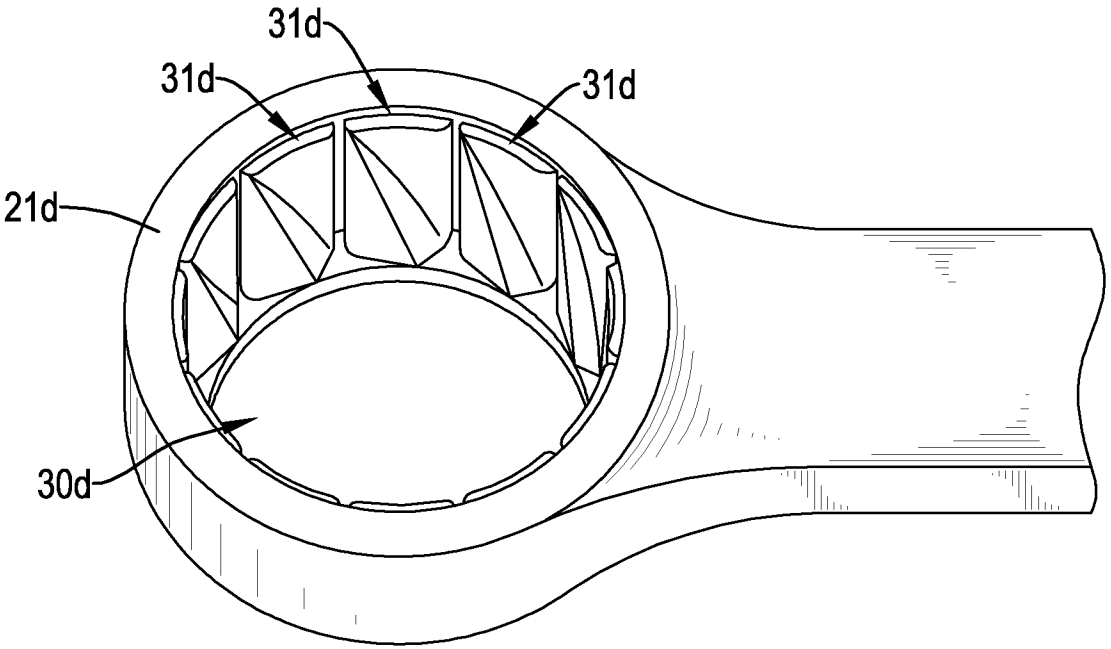
FIG. 12 is a perspective view of a fourth embodiment of the ratcheting wrench in accordance with the present invention.
Figure 13:
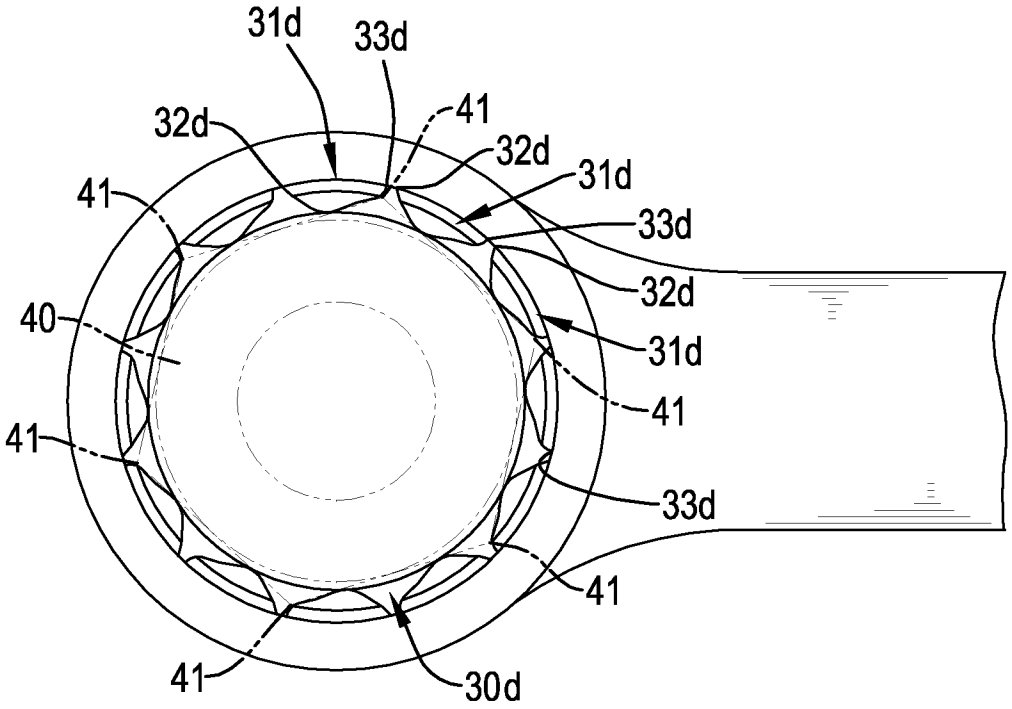
FIG. 13 is a top view of the fourth embodiment of the ratcheting wrench in the present invention engaging a fastener.
Figure 14:
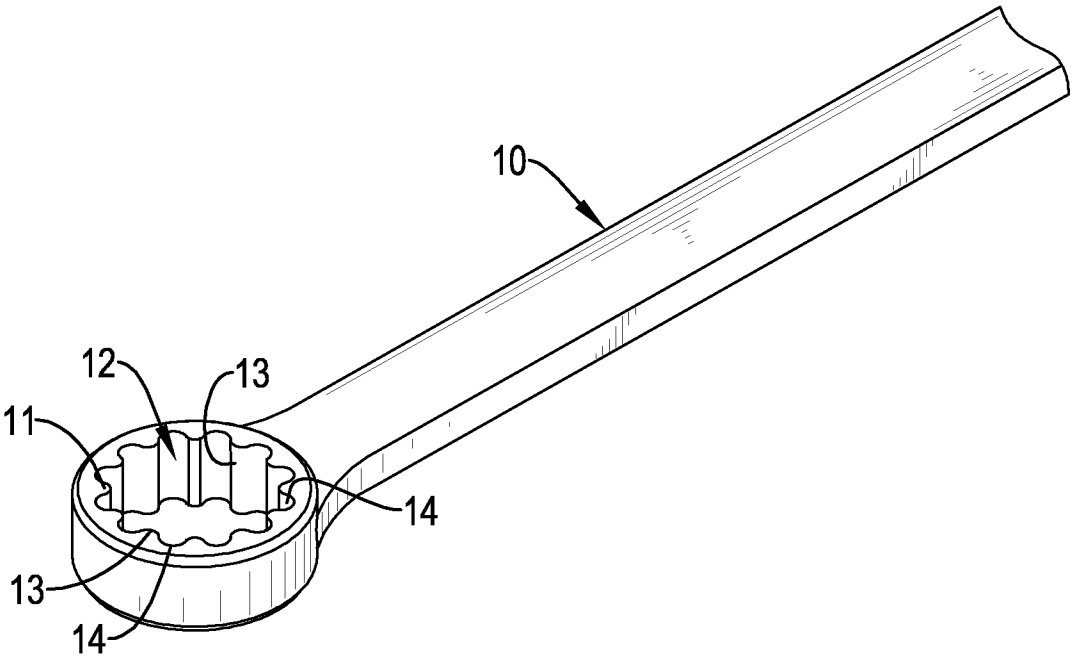
FIG.14 PRIOR ART
FIG. 14 is a perspective view of a conventional wrench.

With reference to FIGS. 12 and 13, in a fourth embodiment of the ratcheting wrench in accordance with the present invention, the elements and effects of the fourth embodiment are the same with the first embodiment, except that the opening is omitted from the driving head 21*d*. The inner surface of the receiving hole 30*d* of the driving head 21*d* is annular and has twelve teeth 31*d* disposed on the inner surface of the receiving hole 30*d*. The hexagonal fastener 40 is received in the receiving hole 30*d*. The six edges of the fastener 40 are located in the receiving hole 30*d*, and each of the six edges abuts the adjacent two of the twelve teeth 31*d*. Each of the six corners 41 of the fastener 40 is located at adjacent two of the twelve teeth 31*d* and is located between and abuts the first side 32*d* of one of the adjacent two teeth 31*d* and the second side 33*d* of the other one of the adjacent two teeth 31*d*.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ratcheting wrench comprising:

a driving head having a receiving hole defined through the driving head and including:

an inner flange inwardly extending from an inner surface of the receiving hole in the driving head; and multiple teeth extending from the inner surface of the receiving hole in the driving head, with each tooth having a bottom connected to the inner flange and including:

an upper edge disposed on a top of the tooth;

a first side located at one side of the tooth;

a second side located at another side of the tooth and being opposite to the first side; and a beveled ridge extending from a juncture between the one of the first and second sides and the upper edge to the inner flange, gradually and inwardly protruding from an inner surface of the tooth, and including:

an engaging bevel inclined toward a juncture between the one of the first and second sides and the inner flange and connected to the one of the first and second sides and the inner flange; and a guiding bevel interfacing with the engaging bevel and inclined toward the juncture between the upper edge and another of the first and second sides; wherein the engaging bevel and the guiding bevel both extend inclinedly from the juncture between the one of first and second sides and the upper edge; wherein the engaging and guiding bevels extend from the one of the first and second sides and from the upper edge and incline to the inner flange; and wherein the driving head is operable in first and second directions, with the driving head driven in the first direction driving an object engaged therewith including the engaging bevel abutting against the object, with the driving head driven in the second direction reverse to the first direction moving relative to the object including the guiding bevel provided to allow the object to slide along the receiving hole.

2. The ratcheting wrench as claimed in claim 1, wherein each tooth has a connecting surface located among the beveled ridge, the second side and the upper edge, and wherein the connecting surface is connected with the second side, the upper edge and the guiding bevel of the beveled ridge.

3. The ratcheting wrench as claimed in claim 2, wherein the beveled ridge of each tooth extends from an inner surface of the inner flange.

4. The ratcheting wrench as claimed in claim 3, wherein the driving head has an opening defined through the driving head and communicating with the receiving hole, and wherein the teeth are equidistantly arranged on the inner surface of the receiving hole in the driving head as an alignment.

5. The ratcheting wrench as claimed in claim 4, wherein the inner flange includes a top and a bottom opposite to the top, wherein the multiple teeth are respectively located at and extend from the top and the bottom of the inner flange and protrude from the inner surface of the receiving hole in the driving head, and wherein an inclined direction of the beveled ridge of each tooth on the top of the inner flange differs from and is mirror-imaged with an inclined direction of the beveled ridge of each tooth on the bottom of the inner flange.

6. The ratcheting wrench as claimed in claim 1, wherein the beveled ridge of each tooth extends from an inner surface of the inner flange.

7. The ratcheting wrench as claimed in claim 1, wherein the driving head has an opening defined through the driving head and communicating with the receiving hole, and wherein the teeth are equidistantly arranged on the inner surface of the receiving hole in the driving head as an alignment.

8. The ratcheting wrench as claimed in claim 1, wherein the inner flange includes a top and a bottom opposite to the top, wherein the multiple teeth are respectively located at and extend from the top and the bottom of the inner flange and protrude from the inner surface of the receiving hole in the driving head, and wherein an inclined direction of the beveled ridge of each tooth on the top of the inner flange differs from and is mirror-imaged with an inclined direction of the beveled ridge of each tooth on the bottom of the inner flange.

9. The ratcheting wrench as claimed in claim 1, wherein the inner flange has a radially extending top surface and an axially extending inner surface of an annular shape extending from the radially extending top surface; wherein the beveled ridge extends to the axially extending inner surface of the inner flange; wherein the engaging bevel is connected to the radially extending upper surface of the inner flange and is located intermediate the inner surfaces of the receiving hole and the inner flange; and wherein the guiding bevel is connected to the radially extending upper surface of the inner flange and is located intermediate the inner surfaces of the receiving hole and the inner flange.

10. The ratcheting wrench as claimed in claim 9, wherein the annular shape is a circular shape.

* * * * *